US008546735B2

(12) United States Patent
Choi et al.

(10) Patent No.: US 8,546,735 B2
(45) Date of Patent: Oct. 1, 2013

(54) MICROWAVE OVEN

(75) Inventors: Sung-Ho Choi, Changwon (KR); Kyu-Young Kim, Changwon (KR); Jae-Myung Chin, Changwon (KR); Sang-Ryul Lee, Changwon (KR); Dong-Han Kim, Changwon (KR); Si-Young Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 12/744,861

(22) PCT Filed: Nov. 20, 2008

(86) PCT No.: PCT/KR2008/006853

§ 371 (c)(1),
(2), (4) Date: Sep. 23, 2010

(87) PCT Pub. No.: WO2009/078592

PCT Pub. Date: Jun. 25, 2009

(65) Prior Publication Data

US 2011/0006056 A1 Jan. 13, 2011

(30) Foreign Application Priority Data

Dec. 17, 2007 (KR) ..... 10-2007-0132490
Dec. 17, 2007 (KR) ..... 10-2007-0132491
Dec. 17, 2007 (KR) ..... 10-2007-0132493

(51) Int. Cl.
*H05B 6/64* (2006.01)

(52) U.S. Cl.
USPC ..... 219/757; 219/702; 219/704; 219/705; 126/21 A

(58) Field of Classification Search
USPC ..... 219/757, 702, 704, 705, 710, 711, 219/715, 723, 758, 690, 681, 756; 126/21 A, 126/299 D, 299 R, 273 R, 275 E
See application file for complete search history.

(56) References Cited

U.S. PATENT DOCUMENTS

| | | | | |
|---|---|---|---|---|
| 7,214,915 | B2 * | 5/2007 | Yamaguchi et al. | 219/757 |
| 2004/0134908 | A1 * | 7/2004 | Jeong | 219/757 |
| 2004/0178192 | A1 | 9/2004 | Muegge et al. | |
| 2007/0045305 | A1 | 3/2007 | Yamaguchi et al. | |

FOREIGN PATENT DOCUMENTS

| | | | |
|---|---|---|---|
| EP | 1 795 812 | A2 | 6/2007 |
| JP | 63201427 | A * | 8/1988 |
| JP | 06-257762 | A | 9/1994 |
| JP | 11-351576 | A | 12/1999 |
| JP | 2000-164332 | A | 6/2000 |
| JP | 2004-239551 | A | 8/2004 |
| JP | 2007-327674 | A | 12/2007 |
| KR | 20-0158620 | Y1 | 10/1999 |
| KR | 20-0160232 | Y1 | 11/1999 |
| KR | 10-2002-0050027 | A | 6/2002 |
| KR | 10-2002-0057117 | A | 7/2002 |
| KR | 10-2006-0013982 | A | 2/2006 |
| KR | 10-20070008045 | A | 1/2007 |
| KR | 10-0745814 | B1 | 7/2007 |
| KR | 10-0766023 | B1 | 10/2007 |

* cited by examiner

*Primary Examiner* — Quang Van
(74) *Attorney, Agent, or Firm* — Birch, Stewart, Kolasch & Birch, LLP

(57) ABSTRACT

A microwave oven is provided. A barrier member prevents airflow provided by a fan assembly from being introduced again to the fan assembly. A separation member divides the airflow provided by the fan assembly to cool a first component and a second component. Thus, the components are efficiently cooled.

16 Claims, 5 Drawing Sheets

MICROWAVE OVEN

TECHNICAL FIELD

The present disclosure relates to a microwave oven, and more particularly, to a microwave oven adapted to more efficiently cool components.

BACKGROUND ART

Microwave ovens are cooking appliances configured to cook foods using microwave and/or heat. Such a microwave oven includes an electronic component for generating microwave and/or a heater for generating heat. The microwave oven also includes a cooling system configured to cool the electronic component and/or the heater.

DISCLOSURE OF INVENTION

Technical Problem

An object of the present disclosure is to provide a microwave oven configured to more efficiently cool components.

Technical Solution

In one embodiment, a microwave oven includes: a cavity including a cooking chamber; a first component and a second component, both at the cavity; a fan assembly at the cavity, the fan assembly including a fan motor and one or more fans driven by the fan motor, the fans providing airflows adapted to cool the first and second components; a barrier member at the cavity, the barrier member preventing the airflow from being introduced again into the fan; and a separation member dividing an airflow provided by the fan assembly into the airflow adapted to cool the first component and the airflow adapted to cool the second component.

In another embodiment, a microwave oven includes: a cavity including a cooking chamber; an electronic component and a heater, both at an upper surface of the cavity; a convection motor at a rear surface of the cavity; a fan assembly at the upper surface of the cavity, the fan assembly including a fan motor, a first fan driven by the fan motor, and a second fan providing an airflow adapted to cool the heater, the first fan providing an airflow adapted to cool the electronic component and the convection motor, and an airflow passing through the cooking chamber; and a separation member separating an airflow provided by the first fan from the airflow provided by the second fan, and dividing the airflow provided by the first fan into the two airflows.

Advantageous Effects

According to embodiments, the components of a microwave oven are cooled efficiently with more simple configuration.

BEST MODE FOR CARRYING OUT THE INVENTION

Hereinafter, a microwave oven according to an embodiment will now be described with reference to the accompanying drawings.

Figure 1:
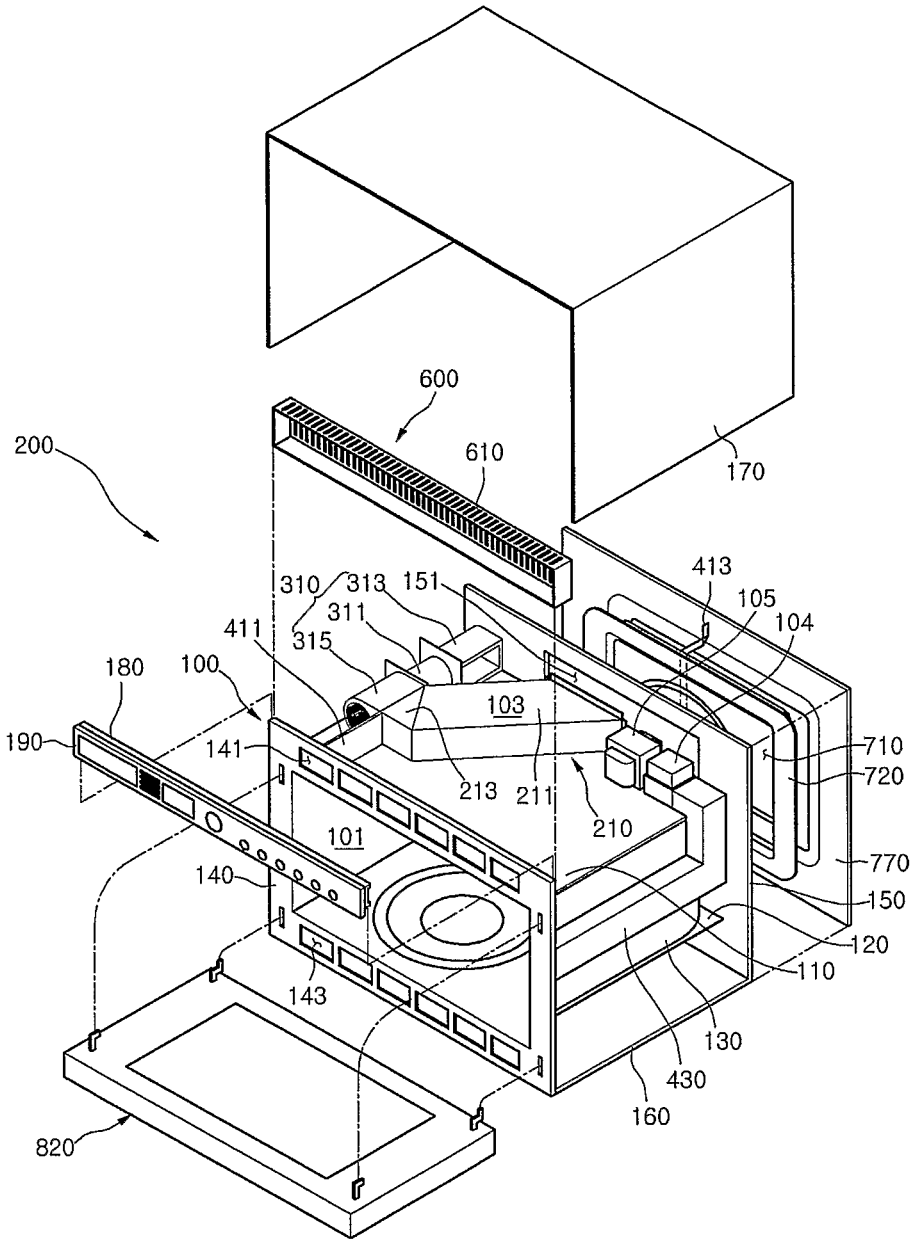
FIG. 1 is an exploded perspective view illustrating a microwave oven according to an embodiment.
Figure 2:
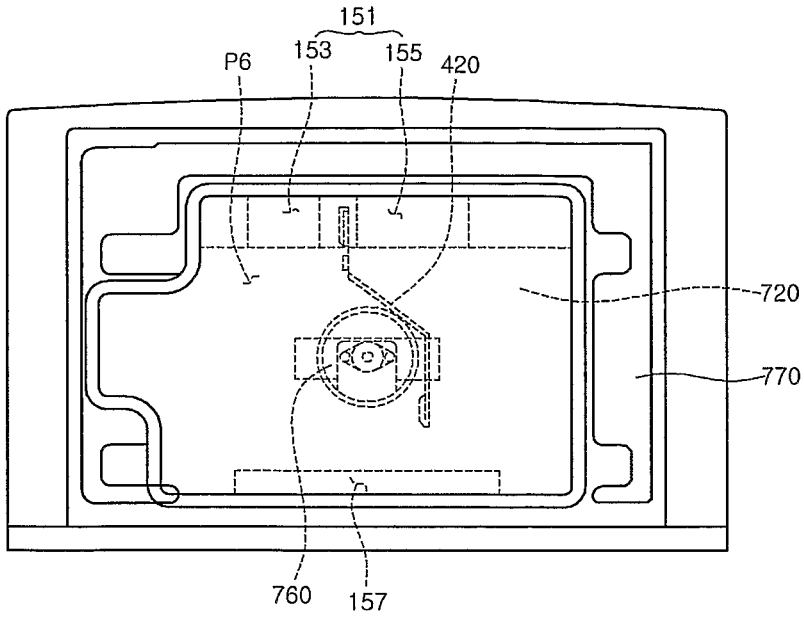
FIG. 2 is a rear view illustrating a rear surface according to an embodiment.

FIG. 1 is an exploded perspective view illustrating the microwave oven according to the embodiment. FIG. 2 is a rear view illustrating a rear surface according to the embodiment.

Referring to FIGS. 1 and 2, a cavity 100 of the microwave oven has an upper surface, a bottom surface, and both side surfaces that are provided with an upper plate 110, a bottom plate 120, and an inner plate 130, respectively. The inner plate 130, having a C-shape opened entirely forward, includes a rear surface and a couple of side surfaces.

Front and rear ends of the cavity 100 are coupled with a front plate 140 and a back plate 150, respectively. The front plate 140 and the back plate 150 substantially define a front appearance and a rear appearance of the microwave oven. The front plate 140 and the back plate 150 respectively include rectangular plates extending out of the upper surface of the upper plate 110, the bottom surface of the bottom plate 120, and the side surfaces of the inner plate 130.

A lower portion of the cavity 100 is coupled with a base plate 160. Front and rear ends of the base plate 160 are fixed to a lower end of the front plate 140 and a lower end of the back plate 150. The base plate 160, coupled to the lower portion of the cavity 100, is spaced a predetermined distance from the bottom plate 120.

An upper portion and both sides of the cavity 100 are coupled with an outer case 170. The outer case 170 includes an upper surface and a couple of side surfaces, and has a C-shape opened entirely downward. In the state where the outer case 170 is coupled to the upper portion and both sides of the cavity 100, the upper surface and the side surfaces of the outer case 170 are spaced a predetermined distance from side surfaces of the upper plate 110 and the inner plate 130, respectively.

A cooking chamber 101 is disposed in the cavity 100. Substantially, a top surface, a bottom surface, a rear surface and both side surfaces of the cooking chamber 101 are provided by the upper plate 110, the bottom plate 120 and the rear and side surfaces of the inner plate 130, respectively. The cooking chamber 101 is a place where foods are cooked by microwaves and/or heat.

A space between the upper surfaces of the upper plate 110 and the outer case 170 includes an electronic chamber 103. The electronic chamber 103 is provided with electronic components for generating microwaves, an upper heater assembly 200 for generating heat, and a fan assembly 310 for cooling the electronic components and the upper heater assembly 200. The electronic components include a magnetron 104 and a high voltage transformer 105.

The upper heater assembly 210 generates heat for heating foods with radiation in the cooking chamber 101. The upper heater assembly 210 includes at least one heater (not shown), a heater cover 211 covering the heater, and a connection duct 213 connecting the heater cover 211 to the fan assembly 310. One end of the heater cover 211 communicates with an intake opening 151 that will be described later. The connection duct 213 connects the other end of the heater cover 211 to the fan assembly 310.

The fan assembly 310 is disposed longitudinally in the left end of the electronic chamber 103, corresponding to the left side of the upper heater assembly 210 with respect to the drawing. The fan assembly 310 includes a single fan motor 311 and a couple of vent fans 313 and 315 respectively provided on both sides of the fan motor 311. Hereinafter, the vent fan 313 on the rear side in the drawing is referred to as a first fan 313, and the vent fan 315 on the front side in the drawing is referred to as a second fan 315. The first fan 313 introduces the indoor air to cool the electronic components including the magnetron 104, the high voltage transformer 105, and a lower heater 780 and a turntable motor 790 that will be described later, and provides airflow for discharging oil and steam from the cooking chamber 101. The second fan 315 provides airflow for cooling the upper heater assembly 210.

The electronic chamber 103 includes a first air barrier 411. The first air barrier 411 prevents air discharged by the fan assembly 310 from going back to the fan assembly 310, more particularly, to the second fan 315. To this end, the first air barrier 411 is disposed between the second fan 315 and the front end of the electronic chamber 103, i.e., the front plate 140. Thus, substantially, the first air barrier 411 separates the left end of the electronic chamber 103 with respect to the drawing, provided with the fan assembly 310, from the rest of the electronic chamber 103 provided with the electronic component and the upper heater assembly 210.

The upper and lower ends of the front plate 140 are provided with a plurality of inlets 141 and a plurality of outlets 143, respectively. The inlets 141 and the outlets 143 of the front plate 140 are respectively provided by cutting the upper end and lower end of the front plate 140 in a predetermined shape. The inlets 141 and the cutlets 143 of the front plate 140 respectively function as an entrance and an exit through which air is introduced and discharged by the fan assembly 310.

The front end of the upper plate 110, corresponding to the rear portion of the inlets 141 in the front plate 140 is provided with an intake grill 600. The intake grill 600 is provided in an approximately flat hexahedron shape with an open front surface. The intake grill 600 guides indoor air introduced through the inlets 141 of the front plate 140 to the fan assembly 310. The intake grill 600 prevents the introduction of outside foreign substances and prevents heat of the upper heater assembly 210 from being transferred to the indoor space. To this end, the front surface and the upper surface of the intake grill 600 are provided with a plurality of inlet holes 610.

The upper end of the front plate 140 is provided with a control bracket 180. The control bracket 180 is provided in a plate shape having a width corresponding to the transverse width of the front plate 140. The front surface of the control bracket 180 is flush with the front surface of the front plate 140.

The front surface of the control bracket 180 is provided with a control panel 190. The control panel 190 receives various operating signals for the operation of the microwave oven, and displays information about the operation of the microwave oven. The control panel 190 provided to the control bracket 180 covers the inlets 141 of the front plate 140 and partially covers the upper portion of the inlet holes 610 in the intake grill 600.

The control panel 190 is cooled by indoor air introduced through the inlets 141 of the front plate 140, and the inlet holes 610 and the intake opening 620 of the intake grill 600. To improve cooling efficiency of the control panel 190, a heat sink (not shown) may be provided to the inner surface of the control panel 190 adjacent to the inlet holes 610 and the intake opening 620 of the intake grill 600.

Referring to FIGS. 1 and 2, the upper and lower ends of the back plate 150 are provided with the intake opening 151 and a discharge opening 157. The intake opening 151 and the discharge opening 157 of the back plate 150 are formed by cutting a portion of the back plate 150 corresponding to the upper side of the upper plate 110 and the lower side of the bottom plate 120. The intake opening 151 of the back plate 150 functions as an entrance where air cooling the upper heater assembly 210 and air cooling the high voltage transformer 105 are introduced. Hereinafter, a portion of the intake opening 151 of the back plate 150 communicating with the electronic chamber 103, corresponding to the rear side of the high voltage transformer 105 is referred to as an electronic chamber intake opening 153, and a portion of the intake opening 151 of the back plate 150 communicating with the upper heater assembly 210 is referred to as a heater intake opening 155. The discharge opening 157 of the back plate 150 communicates with the space between the bottom plate 120 and the base plate 160, so as to function as an exit adapted to discharge air introduced through the intake opening 151 of the back plate 150.

Referring to FIG. 2, a convection chamber 710 is provided on the rear side of the back plate 150 corresponding to the rear surface of the cooking chamber 101. The convection chamber 710 communicates with the cooking chamber 101. The convection chamber 710 is defined substantially by the back plate 150 and a convection cover 720 provided to the inner surface of the back plate 150. The convection cover 720 is provided approximately in a flat hexahedron shape having an open front surface.

A convection heater 730 and a convection fan 740 are disposed in the convection chamber 710. The convection heater 730 may include a sheathe heater bent entirely in a ring shape. The convection fan 740 is disposed in the convection heater 730, and rotates about a longitudinally horizontal rotation shaft. The convection fan 740 introduces air to the center thereof and discharges the air radially.

The convection heater 730 and the convection fan 740 are configured to heat foods in the cooking chamber 101 with convection. That is, when the convection fan 740 is driven, a food in the cooking chamber 101 is convection-heated by air including heat from the convection heater 730 and circulating in the cooking chamber 101 and the convection chamber 710.

A convection motor 760 is provided to the inner surface of the convection cover 720 corresponding to the outside of the convection chamber 710. The convection motor 760 drives the convection fan 740. The convection motor 760 is cooled by air that cools the electronic components and that is introduced through the intake opening 151 of the back plate 150.

The back plate 150 includes a back cover 770. The back cover 770 has a size adapted to cover the intake opening 151 and the discharge opening 157 of the back plate 150 with the convection cover 720. Thus, between the back plate 150 and the back cover 770 is provided a predetermined passage where air introduced through the intake opening 151 of the back plate 150 is discharged through the discharge opening 157 of the back plate 150.

A second air barrier 413 is provided between the back plate 150 and the back cover 770. The second air barrier 413 divides the space between the back plate 150 and the back cover 770 into a passage through which air that cooled the upper heater assembly 210 flows and a passage through which air that cooled the high voltage transformer 105 flows. The convection motor 760 is provided to the passage through which air that cooled the high voltage transformer 105 flows.

Referring to FIG. 1, a waveguide 430 is provided to the side surface on the right side of the inner plate 130 in the drawing. The waveguide 430 is configured to guide air that cooled the magnetron 104, and microwaves generated from the magnetron 104, into the cooking chamber 101.

A discharge duct 440 is provided to the side surfaces on the left side of the inner plate 130 in the drawing, corresponding to the opposite side to the waveguide 430. The discharge duct 440 guides downward air that is guided into the cooking chamber 101 by the waveguide 430 and that passes through the cooking chamber 101. To this end, the discharge duct 440 may be provided in a hexahedron shape having an open bottom surface.

The lower heater 780 (refer to FIG. 4) is disposed between the bottom plate 120 and the base plate 160. The lower heater 780 generates heat for heating foods in the cooking chamber 101 with radiation. The lower heater 780 may include a ceramic heater. The air flowing downward by the fan assembly 310 cools the lower heater 780.

The turntable motor 790 (refer to FIG. 4) is disposed between the bottom plate 120 and the base plate 160 corresponding to the front side of the lower heater 780. The turn table motor 790 provides a driving force for rotating a turntable (not shown) rotatably provided to the bottom surface of the cooking chamber 101. The turntable motor 790 is cooled like the lower heater 780 by air moved downward by the fan assembly 310.

Referring again to FIG. 1, a door 820 is provided to selectively open and close the cooking chamber 101. The door 820 opens and closes the cooking chamber 101 in a pull-down manner where the upper end of the door 820 rotates vertically about a hinge 821 provided to the lower end of the inner surface of the door 820. The upper end of the door 820 is spaced a predetermined distance from the lower end of the control panel 190. The front surface of the door 820 is flush with that of the control panel 190.

Hereinafter, airflow in the microwave oven according to the embodiment will now be described in more detail with reference to the accompanying drawings.

Figure 3:
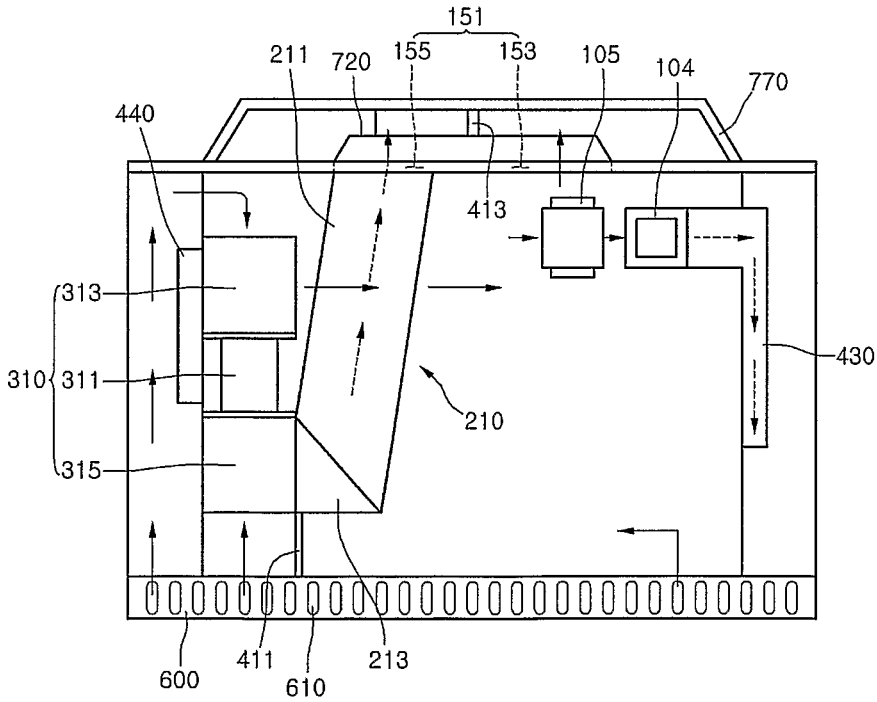
FIG. 3 is a plan view illustrating airflow in a microwave oven according to an embodiment.
Figure 4:
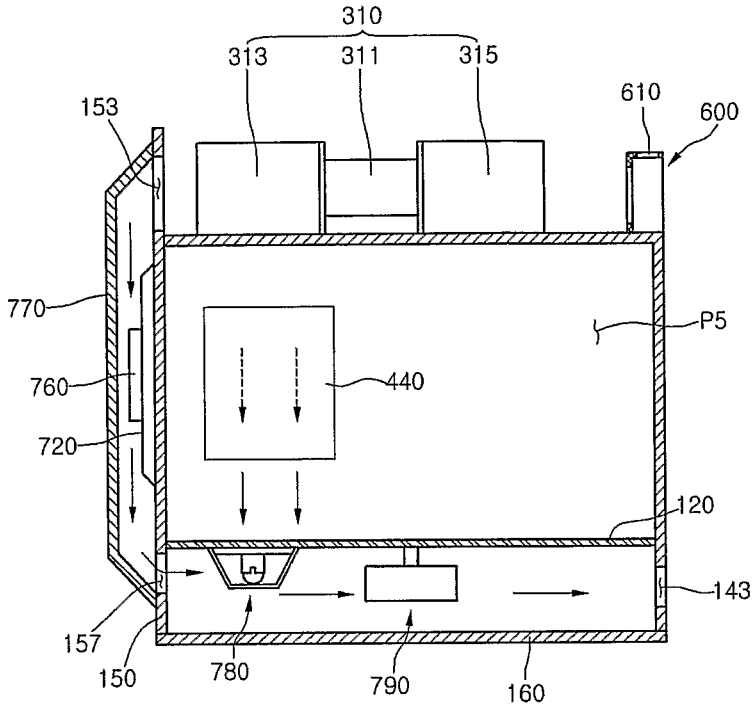
FIG. 4 is a side view airflow according to an embodiment.

FIG. 3 is a plan view illustrating airflow in the microwave oven according to the embodiment. FIG. 4 is a side view airflow according to the embodiment.

First, referring to FIG. 3, when the first fan 313 of the first fan assembly 310 is driven, indoor air is introduced into the intake part of the first fan 313 of the first fan assembly 300 through the inlets 141 of the front plate 140 and the inlet holes 610 of the intake grill 600. The introduced indoor air to the first fan 313 is discharged through the discharge part of the first fan 313 to cool the magnetron 104 and the high voltage transformer 105. One portion of the air cooling the magnetron 104 and the high voltage transformer 105 includes microwave generated from the magnetron 104 flows through the waveguide 430 into the cooking chamber 101. The air flowing into the cooking chamber 101 includes oil and steam generated during cooking foods and is guided to the outside of the cooking chamber 101 by the discharge duct 440. Another portion of the air cooling the magnetron 104 and the high voltage transformer 105 is reflected during cooling the magnetron 104 and the high voltage transformer 105 and flows between the back plate 150 and the back cover 770 through the electronic chamber intake opening 153 of the back plate 150.

The second fan 315 of the fan assembly 310 is driven simultaneously with the driving of the first fan 313. When the second fan 315 is driven, the indoor air is introduced to the intake part of the second fan 315 through the inlets 141 of the front plate 140 and the inlet holes 610 of the intake grill 600. The indoor air introduced to the intake part of the second fan 315 is discharged through the discharge part of the second fan 315 and cool the upper heater assembly 210. The air cooling the upper heater assembly 210 flows between the back plate 150 and the back cover 770 through the heater intake opening 155 of the back plate 150.

The first air barrier 411 prevents the air discharged through the discharge parts of the first fan 313 and the second fan 315 from going back to the intake part of the second fan 315. Also, the second air barrier 413 separates the air discharged between the back plate 150 and the back cover 770 through the discharge part of the first fan 313, from the air discharged between the back plate 150 and the back cover 770 through the discharge part of the second fan 315. Thus, the convection motor 760 is cooled only by the air cooing the magnetron 104 and the high voltage transformer 105 through the discharge part of the first fan 313.

The air flowing between the back plate 150 and the back cover 770 flows between the bottom plate 120 and the base plate 160 and is discharged through the outlets 143 of the front plate 140 to the indoor space. The air flowing between the bottom plate 120 and the base plate 160 cools the lower heater 780 and the turntable motor 790. Although not shown, a barrier, separating the air moved by the first fan 313 from the air moved by the second fan 315, may be disposed between the bottom plate 120 and the base plate 160. The barrier may be configured such that only the air moved by the first fan 313 cools the lower heater 780 and the turntable motor 790.

MODE FOR THE INVENTION

Hereinafter, a microwave oven according to another embodiment will now be described in more detail with reference to the accompanying drawing. The same parts as those of the above described embodiment, will be described using the reference numerals in FIGS. 1 to 4.

Figure 5:
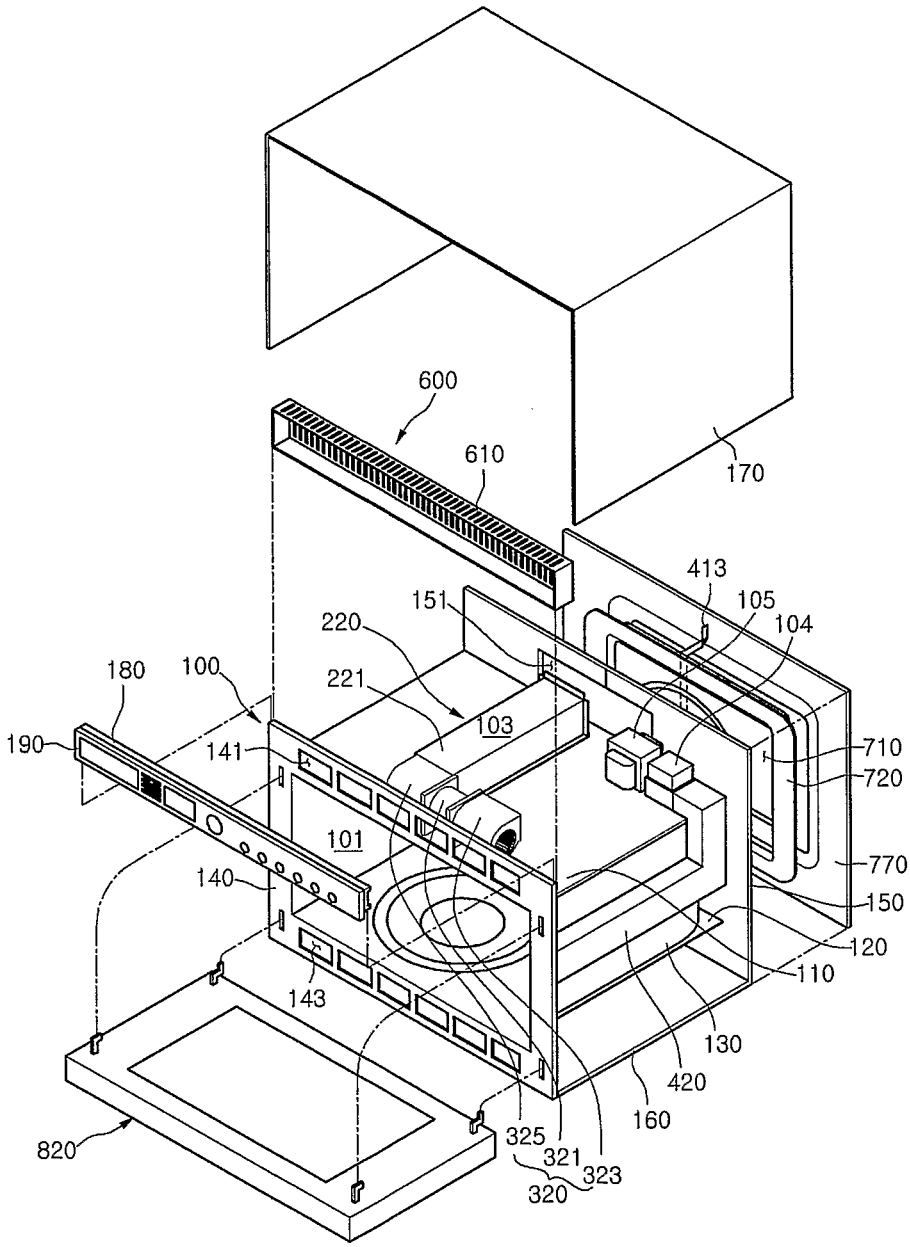
FIG. 5 is an exploded perspective view illustrating a microwave oven according to another embodiment.

FIG. 5 is an exploded perspective view illustrating the microwave oven according to this embodiment.

Referring to FIG. 5, in this embodiment, a fan assembly 320 is disposed transversely in the front end of the electronic chamber 103 corresponding to the front side of an upper heater assembly 220. The fan assembly 320 includes a single fan motor 321, and a first vent fan 323 and a second vent fan 335 that are disposed on both sides of the fan motor 321. The first and second fans 323 and 335 introduce air from the both sides of the electronic chamber 103 and provides airflow directed to the rear side of the electronic chamber 103. The first fan 323 introduces the indoor air to cool the electronic components including the magnetron 104, the high voltage transformer 105, the lower heater 780, and the turntable motor 790, and provides airflow for discharging oil and steam from the cooking chamber 101. The second fan 335 provides airflow for cooling the upper heater assembly 220. To this end, the discharge part of the second fan 335 communicates with an end of a heater cover 221.

That is, according to this embodiment, the intake and discharge passages of air due to the first and second fans 323 and 325 are prevented from crossing each other. Thus, the first air barrier 411 of the previous embodiment can be omitted. Also, according to this embodiment, the electronic chamber intake opening 153 provided to the back plate 150 has a smaller transverse width than the discharge part of the first fan 323. Thus, one portion of the airflow discharged through the discharge part of the first fan 323 and cooling the magnetron 104 and the high voltage transformer 105 is reflected from the back plate 150, and flows substantially to the right side of the drawing. A rest of the airflow discharged through the discharge part of the fan assembly 320 and cooling the magnetron 104 and the high voltage transformer 105 flows through the electronic chamber intake opening 153 of the back plate 150.

Hereinafter, a microwave oven according to further another embodiment will now be described in more detail with reference to the accompanying drawing.

Figure 6:
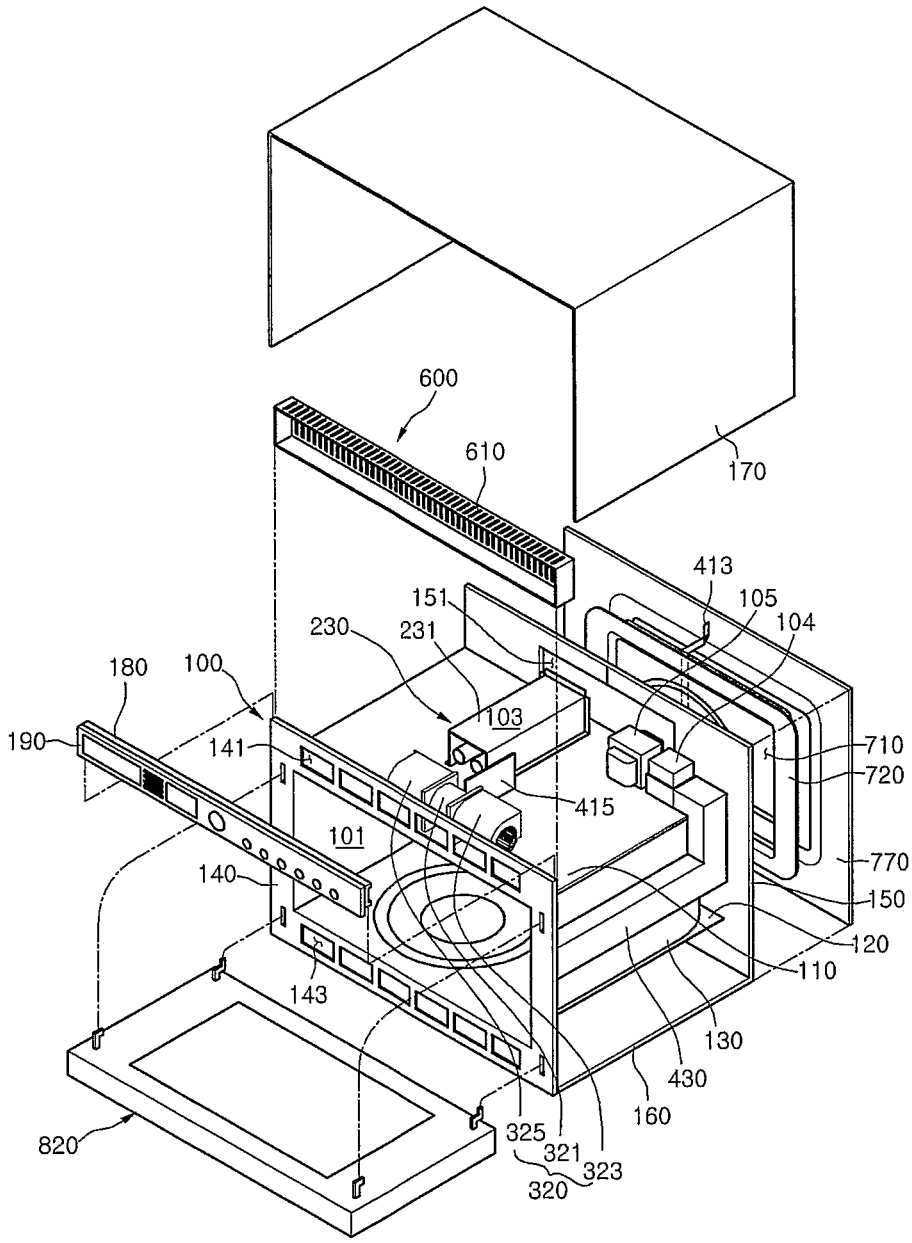
FIG. 6 is an exploded perspective view illustrating a microwave oven according to further another embodiment.

FIG. 6 is an exploded perspective view illustrating the microwave oven according to this embodiment. The same parts as those of the embodiment of FIG. 5, will be described using the reference numerals in FIGS. 1 to 4.

Referring to FIG. 6, according to this embodiment, a discrete first air barrier 415 divides airflow provided by the first and second fans 323 and 325 of the fan assembly 320. More particularly, the first air barrier 415 divides the airflow provided by the air discharged through the discharge parts of the first fan 323 and the second fan 325. To this end, the first air barrier 415 is disposed longitudinally at the upper surface of the electronic chamber 103. The front end of the first air barrier 415 is disposed between the first fan 323 and the second fan 325. The rear end of the first air barrier 415 is disposed on the extension of the boundary between the electronic chamber intake opening 153 and the heater intake opening 155. For example, the first air barrier 415 may be disposed on an imaginary line connecting a boundary point between the discharge parts of the first fan 323 and the second fan 325, to a boundary point between the electronic chamber intake opening 153 and the heater intake opening 155.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

Effects of the microwave ovens according to the embodiments are as follows.

The first and second fan assemblies more efficiently cool the parts forming the microwave oven, and particularly, the electronic components generating microwave and the heaters generating heat. This prevents overheat of the components, so as to improve operation reliability of the microwave oven.

The airflow provided by the two vent fans forming the fan assembly is divided by the barrier member, substantially the heater cover, so as to cool the respect components. Thus, the single fan assembly cools the various components.

The invention claimed is:

1. A microwave oven comprising:

a cavity including a cooking chamber;

a first component and a second component, both at the cavity;

a fan assembly at the cavity, the fan assembly including:

a fan motor; and a first fan and a second fan, each fan driven by the fan motor, the first fan providing a first airflow adapted to cool the first component, and the second fan providing a second airflow adapted to cool the second component;

a barrier member at the cavity, the barrier member preventing the airflow from being introduced into the second fan; and a separation member dividing the first airflow from the second airflow, wherein the first component comprises at least one of at least one electronic component including a magnetron provided to an upper surface of the cavity, and a convection motor provided to a rear surface of the cavity, and wherein the second component comprises a heater provided to the upper surface of the cavity.

2. The microwave oven according to claim 1, wherein one of the first and second fans is provided to an upper surface of the cavity in a manner where an intake part of the one of the first and second fans is directed to a front side or a rear side of the cavity, and a discharge part of the one of the first and second fans is directed to an end of the cavity, and wherein the barrier member separates air introduced to the intake part of the one of the first and second fans from air discharged through the discharge part of the one of the first and second fans.

3. The microwave oven according to claim 1, wherein the separation member comprises a heater cover covering the heater.

4. The microwave oven according to claim 1, wherein the separation member comprises a heater cover covering the heater and having an end communicating with a discharge part of one of the first and second fans.

5. The microwave oven according to claim 1, wherein the separation member comprises:

a heater cover covering the heater; and a connection duct having both ends communicating with a discharge part of one of the one of the first and second fans, and an end of the heater cover.

6. The microwave oven according to claim 1, wherein the first airflow cooling the first component further cools a third component.

7. The microwave oven according to claim 6, wherein the third component comprises at least one of a heater and a turntable motor that is disposed on a lower side of the cavity.

8. A microwave oven comprising:

a cavity including a cooking chamber;

an electronic component and a heater, both at an upper surface of the cavity;

a convection motor at a rear surface of the cavity;

a fan assembly at the upper surface of the cavity, the fan assembly including:

a fan motor;

a first fan driven by the fan motor; and a second fan driven by the fan motor;

wherein the first fan provides a first airflow adapted to cool the electronic component and the convection motor, and an airflow passing through the cooking chamber, and wherein the second fan provides a second airflow adapted to cool the heater; and a separation member separating the first airflow provided by the first fan from the second airflow provided by the second fan, and dividing the airflow provided by the first fan into the airflows to cool the electronic component and the convection motor, and to pass through the cooking chamber.

9. The microwave oven according to claim 8, wherein the separation member comprises:

a first separation member separating the airflow, provided by the first fan and cooling the electronic component and the convection motor, from the second airflow provided by the second fan and cooing the heater; and a second separation member directing a portion of the airflow provided by the first fan to the electronic component, and directing a rest of the airflow provided by the first fan to the convection motor.

10. The microwave oven according to claim 9, wherein the first separation member comprises a heater cover covering the heater.

11. The microwave oven according to claim 9, wherein the first separation member comprises:

a heater cover covering the heater; and a connection duct having both ends communicating with a discharge part of the second fan and the heater cover.

12. The microwave oven according to claim 9, wherein the second separation member comprises a back plate, and wherein the back plate provides the rear surface of the cavity, and reflects and guides the portion of the airflow provided by the first fan to the electronic component, and receives and guides the rest of the airflow to the convection motor, and provides a rear appearance.

13. The microwave oven according to claim 9, wherein the second separation member is disposed longitudinally in a flow direction of the airflow and reflects the portion of the airflow provided by the first fan to the electronic component, and wherein the second separation member comprises an opening overlapping a portion of a discharge part of the first fan and guiding the rest of the first airflow provided by the first fan to the convection motor.

14. The microwave oven according to claim 13, wherein the opening overlaps, in the flow direction of the first airflow, both the portion of the discharge part of the first fan and an entire discharge part of the second fan, and wherein the portion of the first airflow provided by the first fan and the second airflow provided by the second fan, passing through the opening, are separated from each other.

15. The microwave oven according to claim 8, wherein the first airflow provided by the first fan and cooling the electronic component circulates in the cooking chamber and is discharged from the cooking chamber.

16. The microwave oven according to claim 8, wherein the first airflow provided by the first fan and cooling the convection motor cools at least one of a lower heater and a turntable motor disposed on a lower side of the cavity.

* * * * *